US008186010B2

(12) United States Patent
Tomiji et al.

(10) Patent No.: US 8,186,010 B2
(45) Date of Patent: May 29, 2012

(54) RETRACTING MECHANISM AND FIXING STRUCTURE

(75) Inventors: Katsuyasu Tomiji, Chigasaki (JP); Kazuyuki Tomioka, Kanagawa (JP)

(73) Assignee: Nifco Inc., Yokohama-Shi (JP)

( * ) Notice: Subject to any disclaimer, the term of this patent is extended or adjusted under 35 U.S.C. 154(b) by 374 days.

(21) Appl. No.: 12/448,040

(22) PCT Filed: Dec. 5, 2007

(86) PCT No.: PCT/JP2007/073519

§ 371 (c)(1),
(2), (4) Date: Jul. 16, 2009

(87) PCT Pub. No.: WO2008/069248

PCT Pub. Date: Jun. 12, 2008

(65) Prior Publication Data

US 2010/0031468 A1 Feb. 11, 2010

(30) Foreign Application Priority Data

Dec. 8, 2006 (JP) ..... 2006-332237

(51) Int. Cl.
*E05F 3/00* (2006.01)

(52) U.S. Cl. ..... 16/64; 16/62; 16/71; 16/75; 16/79; 292/51; 292/199; 292/280

(58) Field of Classification Search ..... 16/64, 71, 16/75, 79, 86 C, DIG. 7, DIG. 9, DIG. 10, 16/82; 292/51, 197, 199, 219, 220, 224, 292/280

See application file for complete search history.

(56) References Cited

U.S. PATENT DOCUMENTS

| | | | | |
|---|---|---|---|---|
| 889,168 | A * | 5/1908 | Zopfchen et al. | 16/64 |
| 2,899,702 | A * | 8/1959 | Voster et al. | 16/66 |
| 2,933,755 | A * | 4/1960 | Carlson | 16/55 |
| 4,369,545 | A * | 1/1983 | Maublanc | 16/64 |
| 4,665,583 | A * | 5/1987 | Frolov et al. | 16/52 |
| 5,343,593 | A * | 9/1994 | Fayngersh | 16/52 |
| 5,639,130 | A * | 6/1997 | Rogers et al. | 292/216 |
| 6,327,879 | B1 * | 12/2001 | Malsom | 70/97 |
| 6,848,759 | B2 * | 2/2005 | Doornbos et al. | 312/319.1 |
| 7,393,068 | B2 * | 7/2008 | Sato et al. | 312/333 |
| 7,743,464 | B2 * | 6/2010 | Tomioka et al. | 16/64 |
| 7,945,993 | B2 * | 5/2011 | Tomioka et al. | 16/64 |
| 8,001,654 | B2 * | 8/2011 | Tomioka et al. | 16/64 |
| 2001/0008037 | A1 * | 7/2001 | Brustle | 16/71 |

FOREIGN PATENT DOCUMENTS

| | | |
|---|---|---|
| JP | S62-225676 | 10/1987 |
| JP | 2533763 | 4/1992 |
| JP | H07-102850 | 4/1995 |
| JP | 2001-245738 | 9/2001 |

(Continued)

*Primary Examiner* — Jack W. Lavinder
*Assistant Examiner* — Roberta Delisle
(74) *Attorney, Agent, or Firm* — Manabu Kanesaka

(57) ABSTRACT

A catcher (2) provided in a door frame H' for capturing a striker body 1 moved from a near front side F when a door D' is rotated toward a reference position; a braking device (5); and a linkage device (3) for both are provided. The catcher (2) is provided to be reciprocatingly rotatable between a standby position and a rotated position, captures the striker body (1) at the standby position, and rotates forward to the rotated position. Braking of the braking device (5) is applied to a rotation toward the rotated position of the catcher (2) through the linkage gear member (30).

14 Claims, 8 Drawing Sheets

FOREIGN PATENT DOCUMENTS

| | | |
|---|---|---|
| JP | 2004-052454 | 2/2004 |
| JP | 2005-127527 | 5/2005 |
| JP | 2005-188693 | 7/2005 |
| JP | 2006-083551 | 3/2009 |
| WO | WO 2007/055204 | 5/2007 |

* cited by examiner

RETRACTING MECHANISM AND FIXING STRUCTURE

FIELD OF THE INVENTION

This invention relates to an improvement of a retracting mechanism and a fixing structure thereof for a door and the like.

BACKGROUND OF THE ART

As for a mechanism which is provided in a door frame as a main body comprising a catcher which captures a striker body provided in a door as a rotating body in the process of a rotation toward a closed position thereof, and rotates the door to the closed position by force, there is a retracting mechanism the applicants invented.

In the mechanism, further, due to the rotation of the catcher, a piston rod comprising a load-response type braking device is pushed in, thereby decelerating the movement immediately before the door reaches the closed position.

DISCLOSURE OF THE INVENTION

Problems to be Solved by the Invention

A main problem to be solved by the present invention is, firstly, to provide a new method which further moves a movable member comprising a braking device in proportion to a rotation volume of a catcher in the retracting mechanism.

Also, secondly, the retracting of a door as a rotating body can be carried out without an unpleasant feeling due to the retracting mechanism.

Means for Solving the Problems

In order to solve the above-mentioned problem, in this invention, a retracting mechanism is provided with the following structures of (1) to (6).

(1) a striker body provided in either one of a rotational body and a main body to which the rotational body is rotatably attached;

(2) a catcher provided on the other of those for capturing the striker body which is moved from the near front side or relatively moved when the rotational body is rotated from an open position to a reference position;

(3) a braking device for applying a resistance force to the movement of a movable member; and (4) linkage means between the catcher and the braking device, are provided, wherein (5) the catcher is provided so as to be reciprocatingly rotatable between a standby position and a rotated position, thereby capturing the striker body at the standby position, and rotating toward the rotated position; and (6) due to the linkage means, in proportion to a rotation volume of the catcher, the movable member comprising the braking device can be moved farther.

In the process wherein the rotational body in the open position is rotated to the reference position, the striker body is captured by the catcher in a predetermined position. Due to a forward rotation toward the rotated position of the catcher after the capture, the rotational body is retracted in the reference position. Also, due to the linkage means, a movable member side of the braking device can be moved further than a forward rotation volume of the catcher. Thus, in a final stage wherein the rotational body reaches the reference position, a large braking force can be applied to the rotational body as much as possible.

If the braking device is a load-response type, the braking device can further apply the braking to the rotational body immediately before the rotational body reaches the reference position. As for the braking device, a damper shown in a Japanese Unexamined Patent Application Publication (TOKKAI) No. 2005-188693 disclosed by applicants of this invention can be employed.

The linkage means may include a linkage gear member comprising small-diameter gear member connected to a catcher side and a large-diameter gear member connected to the movable member side of the braking device and rotated together with the small-diameter gear member.

In this case, the linkage gear member connecting the small-diameter gear member to the catcher side due to the forward rotation of the catcher is rotated to the extent of the forward rotation. However, since the large-diameter gear member of the linkage gear is connected to the movable member side of the braking device, the movable member side can be moved more than the forward rotation volume of the catcher. Therefore, in the final stage wherein the rotational body reaches the reference position, a large braking force can be applied to the rotational body as much as possible.

The braking device is structured in such a way as to comprise a piston as a movable member and a cylinder and apply resistance of viscose fluid encapsulated in the cylinder to the push-in movement of the piston. The linkage means includes a first slider provided with a rack engaging with a pinion-like portion formed in the catcher and the small-diameter gear member of the linkage gear member; and a second slider provided with a rack engaging with the large-diameter gear member of the linkage gear member. Due to the movement of the second slider, the piston comprising the braking device may be pushed in or relatively pushed in.

In this case, through the linkage gear member and the second slider, the braking of the braking device can be applied to the movement of the first slider which is moved due to the rotation toward the rotated position from the standby position of the catcher. Also, in the final phase of the rotation toward the reference position of the rotational body, the rotation can be carried out slowly. Especially, the braking device can be arranged on a lateral side of the catcher.

The retracting mechanism may include a catcher unit for housing the catcher, the braking device, and the linkage means. The catcher unit may have width and length so that along a length direction thereof, first and second racks are moved. Moreover, the width of the catcher unit may have such a size as to be housed between a side face on a side opposite to a face of the door as the rotational body bumping in a doorstop portion of a door frame as the main body; and a side face of the door frame on a side opposite to the side face.

In this case, on the lower face of an upper frame portion of the door frame, the catcher, braking device and linkage means which comprise the retracting mechanism can be provided easily and properly without projecting the door frame.

Also, the braking device may be structured in such a way as to comprise the piston and the cylinder and apply the resistance of the viscose fluid encapsulated in the cylinder to the push-in movement of the piston. The braking device may be provided between a pushed-in portion of a piston rod connected to the piston and a pushed-in portion of the back end portion opposite to a projecting side of the piston rod of the cylinder. The pinion-like portion may be provided in the catcher, and the linkage pinion comprising the linkage means may be provided on the lateral side of the catcher. Moreover, the braking device may include the first slider comprising the linkage means provided with a rack for engaging with the pinion-like portion of the catcher and the linkage pinion; and the second slider comprising the linkage means provided with a rack engaging with the linkage pinion in a side opposite to the first slider. One of the pushed-in portion of the piston rod and the pushed-in portion of the back end portion of the cylinder may be moved due to the movement of the first slider, and the other of those may be moved due to the movement of the second slider.

Also, in this case, furthermore, there may be provided a tension coil spring having one end fastened to the other end of a linkage rod having one end rotatably attached to a biased position from the rotation center of the linkage pinion, the other end of the spring being fastened to a supporting body of the linkage pinion. When the front end of the spring, the back end of the spring, and the rotation center of the linkage pinion are positioned in one imaginary line, the tension coil spring is most stretched, and the catcher may be positioned in an intermediate position between the standby position and the rotated position through the first slider.

In this case, the catcher in the standby position can push the piston as the movable member of the braking device into the cylinder of the braking device through the first slider and the second slider more than the rotation volume rotated in the rotated position. Accordingly, the braking of the load-response type braking device can be applied to the rotational body as much as possible immediately before the rotational body reaches the reference position.

Also, due to the linkage rod, a spring winding portion of the tension coil spring never contacts the linkage pinion. Therefore, the rotation of the linkage pinion is never prohibited by the spring winding portion.

Also, in order to achieve the above-mentioned problem, in the invention, a fixing structure of the retracting mechanism explained above fixes the retracting mechanism in such a way that when a space between a free end of the door as the rotational body and the door frame as the main body, comes to be in a range of 10% to 20% of the width of the door, the catcher captures the striker body.

In this case, the forceful rotation toward a closed position (reference position) of the door can be started without impairing normal usage of the door, or having the unpleasant feeling.

Effects of the Invention

According to a retracting mechanism of the present invention, in a final stage wherein a rotational body reaches the reference position, a large braking force can be applied to the rotational body as much as possible. Also, according to the fixing structure of the present invention, forceful rotation toward the closed position (reference position) of the door can be started without impairing the normal usage of the door, or having the unpleasant feeling.

BEST MODE FOR CARRYING OUT THE INVENTION

Hereinafter, the best mode for carrying out the present invention will be explained with reference to FIGS. 1 to 8.

Figure 1:
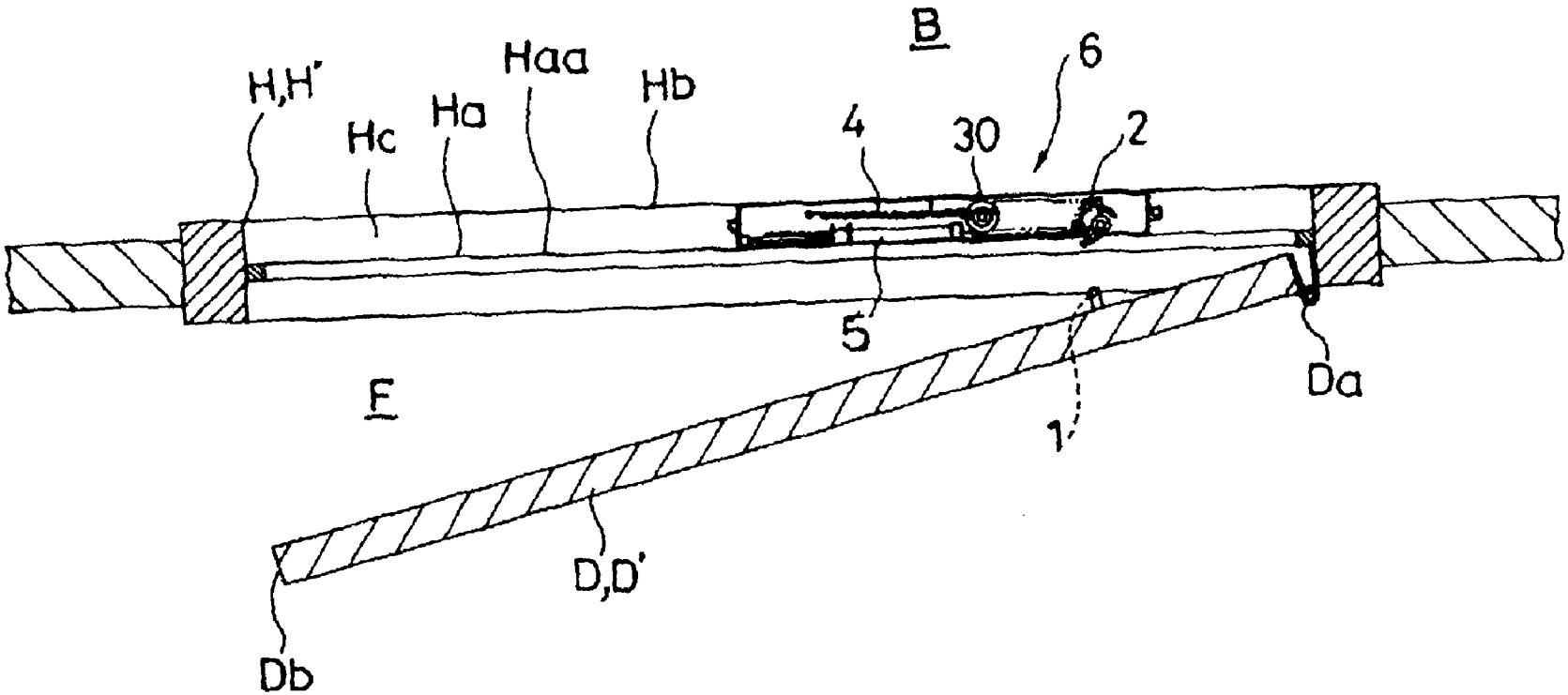
FIG. 1 is a bottom structural view showing a used state of a retracting mechanism.
Figure 2:
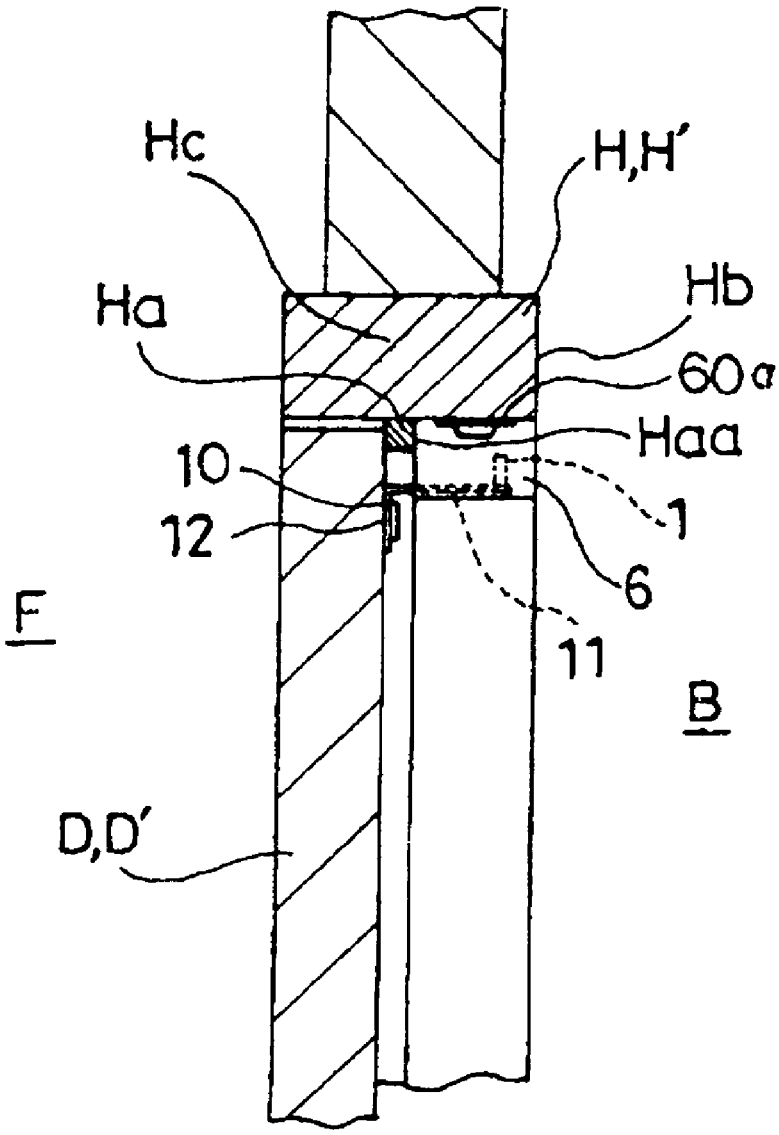
FIG. 2 is a sectional structural view of the same as above.
Figure 3:
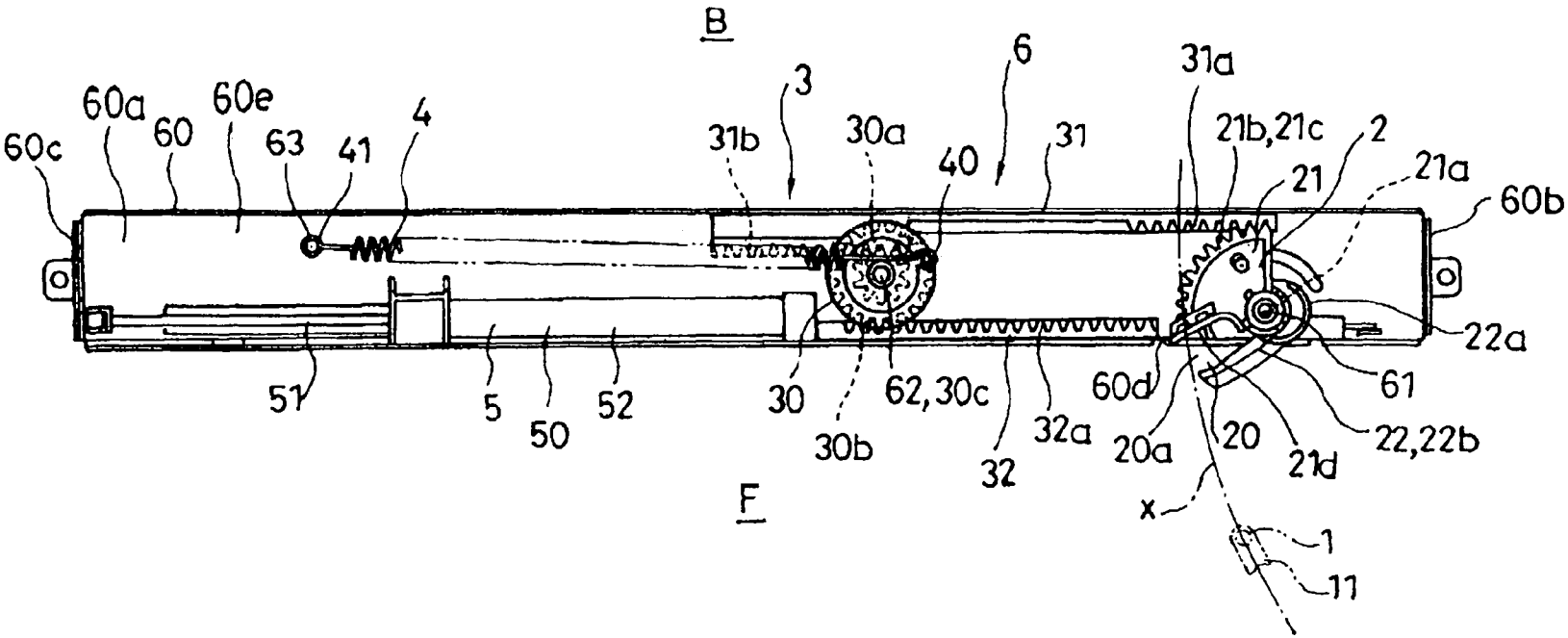
FIG. 3 is a bottom structural view of a catcher unit 6 comprising the retracting mechanism.
Figure 4:
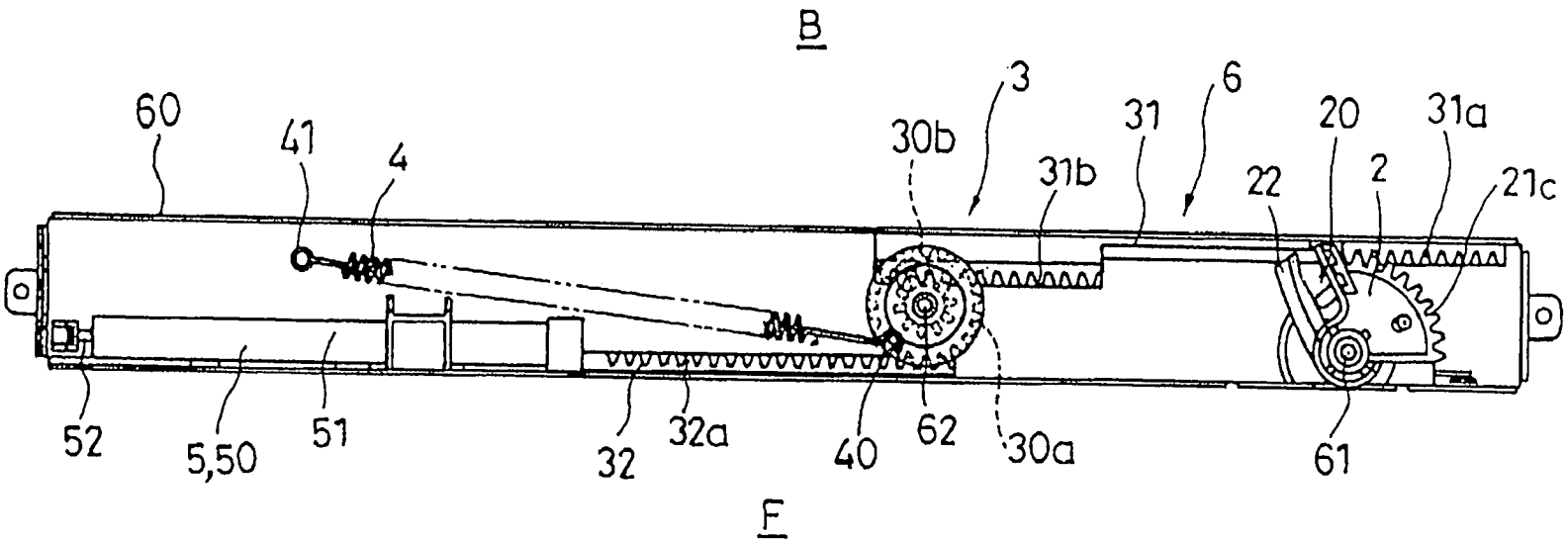
FIG. 4 is a bottom structural view of the same as above.
Figure 5:
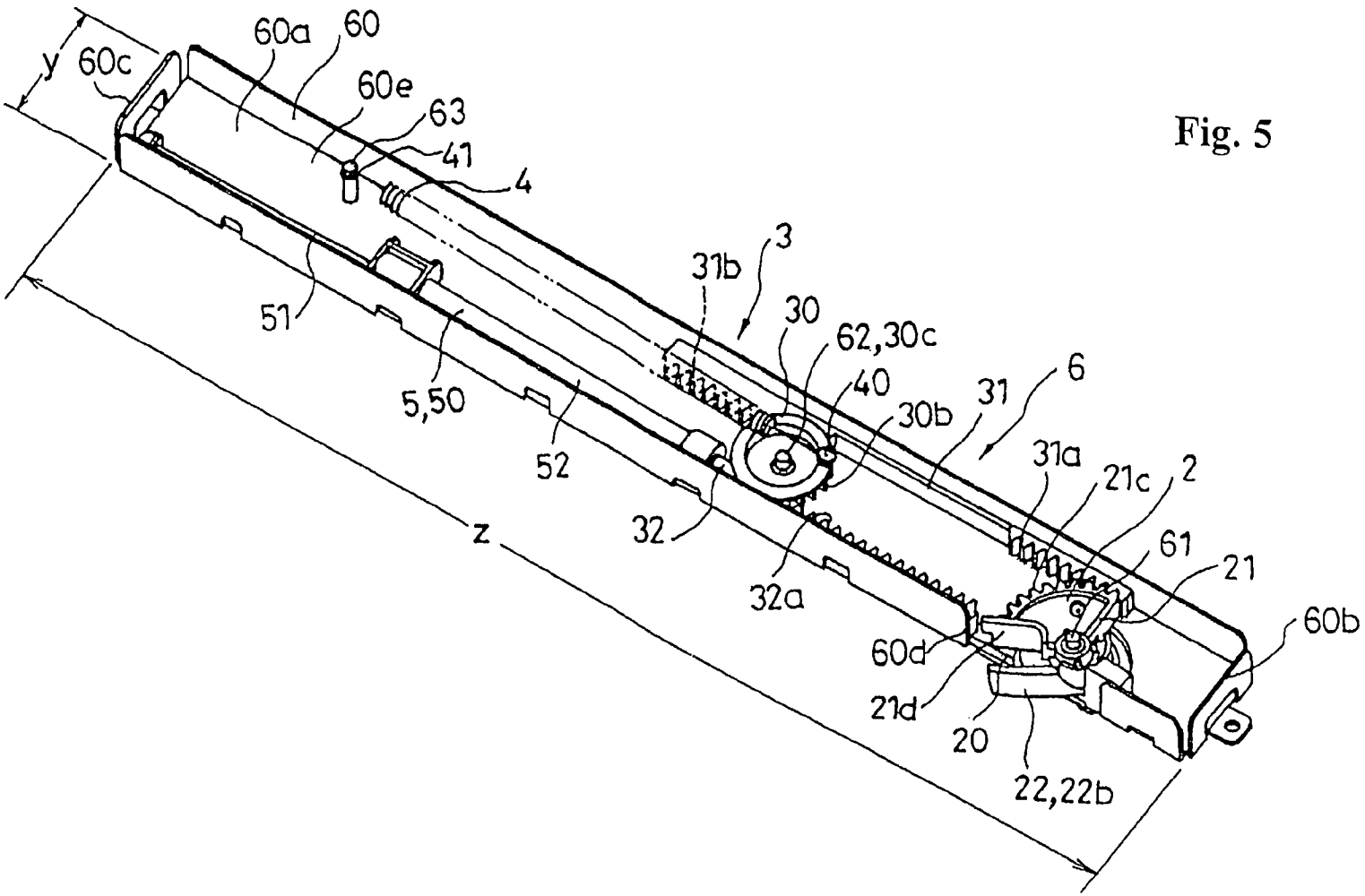
FIG. 5 is a perspective structural view of the same as above.
Figure 6:
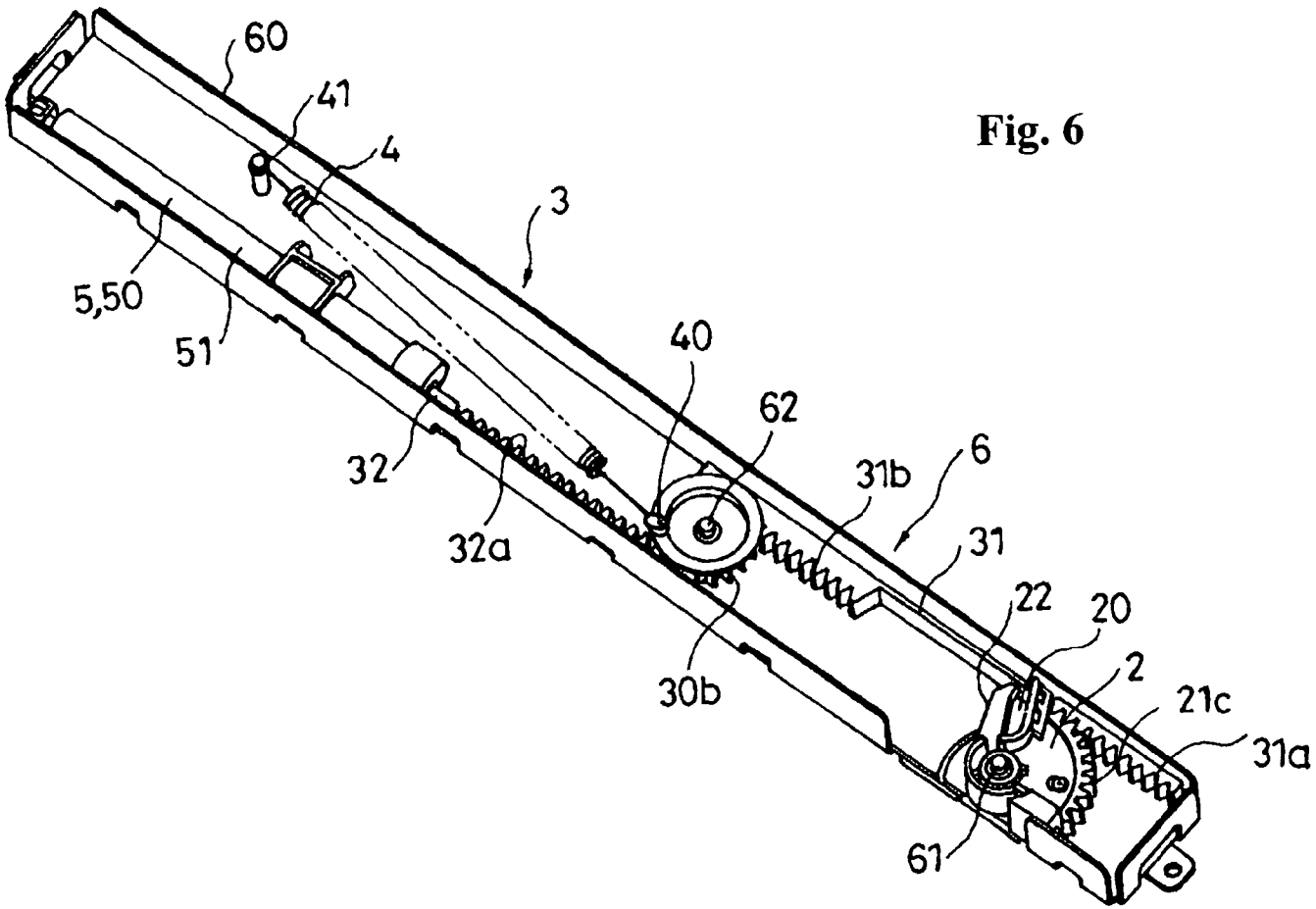
FIG. 6 is a perspective structural view of the same as above.

Incidentally, here, FIG. 1 shows a state wherein a retracting mechanism is used for retracting a door D' viewed from underneath, and FIG. 2 shows a state of a longitudinal section of the above, respectively. Also, FIGS. 3, 5 show states wherein a catcher 2 comprising the retracting mechanism is in a standby position, and FIGS. 4, 6 show states wherein the catcher 2 is in a rotated position, respectively.

Figure 7:
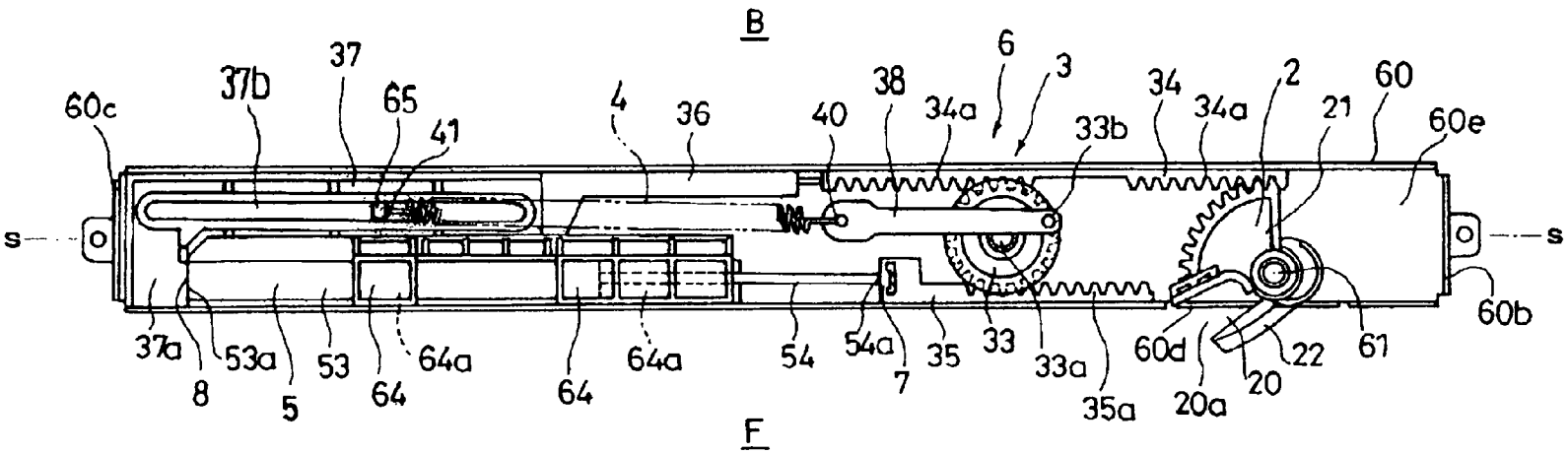
FIG. 7 is a bottom structural view of the catcher unit 6 comprising another structural example of the retracting mechanism.
Figure 8:
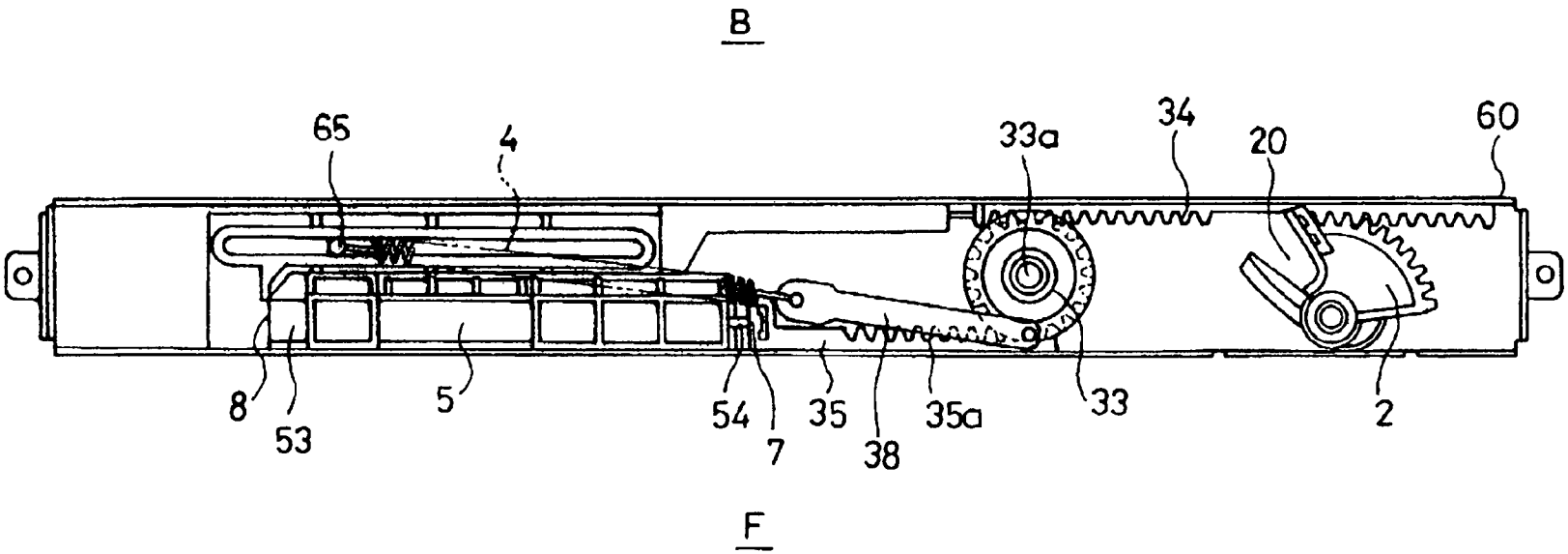
FIG. 8 is a bottom structural view of the catcher unit 6 comprising another structural example of the retracting mechanism.

Also, FIGS. 7, 8 show an example wherein one portion of the structure of the retracting structure shown in FIGS. 1 to 6 is changed; FIG. 7 shows a state wherein the catcher 2 comprising the retracting mechanism is in a standby position; and FIG. 8 shows a state wherein the catcher 2 is in the rotated position, respectively.

The retracting mechanism according to the embodiment absorbs an impact when a rotational body D in an open position (position except for the closed position of the door D' such as the position in FIG. 1) is rotated to a reference position (closed position of the door D' such as a position in FIG. 2). Also, at the same time, the retracting mechanism forcibly retracts a rotational body D which has come to be rotated toward the reference position from a predetermined rotational position to the reference position, and stably positions the rotational body D to the reference position.

In the example shown in FIGS. 1, 2, as an example for the rotational body D, the door D' (door) is shown. One end portion of the door D' is supported to a main body H side wherein the rotational body D is rotatably attached. Here, the rotational body D is rotatably attached to a door frame H' side by hinges. In the position wherein a free end Db facing a rotational supporting side Da is bumped into a doorstop portion Ha of the door frame H', the door D' closes an opening portion in the door frame H'.

In the example, in a position near the rotational supporting side Da of the rotational body D, a striker body 1 comprising the retracting mechanism is provided, and also the catcher 2 and a braking device 5 are provided in a main body H. In this case, unlike the case that those are provided on a free end Db side of the rotational body D, the catcher 2 can capture the striker body 1 at the position wherein the rotational body D is rotated to some extent toward the reference position, and the rotational body D can be retracted. Also, the braking can be provided to the rotation of the rotational body D.

Also, in the example, the striker body 1 is attached to the door D' in such a way that when a space between the free end Db of the door D' as the rotational body and the door frame H' as the main body H comes to be in a range of 10% to 20% of the width of the door D', the catcher 2 captures the striker body. Also, the catcher 2 is placed in the door frame H'. Therefore, in the example, forceful rotation toward the closed position (reference position) of the door D' can be started without impairing the normal use of the door D' or without having the unpleasant feeling.

In many cases, the width of the door D' (hinged door and door) used for a residential house and the like is approximately 1 m. However, in this case, it is recognized that it is convenient and natural for usage of the door D' that a forceful rotation toward the closed position of the door D' starts from the position wherein a distance between the free end Db of the door D' and the door frame H' comes to be approximately 10 cm.

Also, in the example, the hereinafter described catcher 2, braking device 5, and linkage means 3 are housed in a case 60, and called as a catcher unit 6. The catcher unit 6 has a width y and a length z, and along the length direction, the hereinafter described first and second sliders 31, 32 are moved in the catcher unit 6. Also, the width y of the catcher unit 6 has a size so as to be housed between a side face Haa in the doorstop portion Ha of the door frame H', opposite to a side of the door D' bumping into the doorstop portion Ha of the door frame H'; and a side face Hb of the door frame H' which is on the opposite side of the side face Haa. Therefore, in the example, on the lower face of an upper frame portion Hc of the door frame H', the catcher 2, the braking device 5, and the linkage means 3 comprising the retracting mechanism can be easily and properly provided without sticking out of the door frame H'. (FIG. 2)

The retracting mechanism is provided with the striker body 1, the catcher 2, braking device 5, and the linkage means 3. The striker body 1 is provided on a rotational body D side (in the example shown in figures, a door D' side). In the example shown in the figures, as described hereinafter, the catcher 2 is provided on the lower face of the upper frame portion Hc of the door frame H' with a slight space from the rotational supporting side Da of the door D'. Corresponding to this, the striker body 1 is provided in the upper portion of the door D' with a slight space from the rotational supporting side Da of the door D'. More specifically, the striker body 1 is structured in such a way as to be an end portion of one side arm 11 of an L-shaped body 10 and form an axis projecting upwardly from the face on the outside of the curve. The striker body 1 is attached to the door D' by fixing the L-shaped body 10 to one surface of the door D' by the other arm 12 of the L-shaped body 10.

The catcher 2 is provided on a door frame H' side which is closed by the door D'. When the opened door D' is rotated toward the reference position, the catcher 2 captures the striker body 1 which is moved from a near front side F (in the example, front) in a predetermined rotational position of the door D'.

In the example shown in the figures, the catcher 2 is provided on the lower surface of the upper frame portion Hc of the door frame H' with a slight space from the rotational supporting side Da of the door D'.

In the example shown in the figures, the catcher 2 is rotatably attached inside the case 60 which has a roughly rectangular box shape whose lower surface is open. The case 60 is attached to the upper frame portion Hc of the door frame H' at a ceiling face portion 60*a* of the case 60, so that the catcher 2 is provided in the upper frame portion Hc of the door frame H'.

Also, in the example shown in the figures, the catcher 2 is provided in one end side 60*b* of the case 60. The case 60 is attached to the upper frame portion Hc in a state wherein one end side 60*b* of the case 60 faces the rotational supporting side Da of the door D', and the length direction of the case 60 goes along the length direction of the upper frame portion Hc. In the side portion which is one end side 60*b* of the case 60 and faces the near front side F, a notch portion 60*d* is formed, and in a standby position described hereinafter, one portion of the catcher 2 projects to the outside of the case 60 from the notch portion 60*d*. In the predetermined rotational position of the door D', the striker body 1 enters into a hooking groove 20 of the catcher 2 which is in the standby position. After this, the catcher 2 is rotated to the rotated position beyond an intermediate position, so that the striker body 1 is retracted into the case 60, and the door D' is positioned in the reference position and completely closed. An open portion 60*e* of the case 60 is closed up by a cover which is not shown.

Also, the catcher 2 is provided to be rotatable between the standby position (position in FIG. 3) and the rotated position (position in FIG. 4), and structured so that when the catcher 2 is positioned closer a standby position side than the intermediate position between the standby position and the rotated position, an urging force facing toward the standby position is received, and when the catcher 2 is positioned closer the rotated position than the intermediate position, an urging force facing toward the rotated position is received.

In the example, due to an operation of a tension coil spring 4 whose one end 40 of the spring is fastened to a linkage gear member 30 comprising the linkage means 3 described hereinafter, the above-mentioned urging force can be applied to the catcher 2.

In the example shown in the figures, the catcher 2 is structured by combining a main part 21 and a sub part 22.

The main part 21 is structured in the form of a plate with roughly a fan shape. In the position which becomes a center of a fan of the main part 21 with the fan shape, an axis bore 21*a* is formed. A rotation axis 61 provided with a head portion on the lower end of an axis attached to the case 60 as a supporting body in such a way that an axis line goes along an up-and-down direction, penetrates through the axis bore 21*a*, and the main part 21 is attached to the rotation axis 61. In an arc-like marginal portion 21*b* of the main part 21, a pinion-like portion 21*c* is formed, and the pinion-like portion 21*c* is engaged with a rack 31*a* of the first slider 31 described hereinafter.

The sub part 22 is provided with a base portion 22*a* forming a circular disc and an arm portion 22*b* integrally connecting the base end to the base portion 22*a* and projecting from the base portion 22*a*. The sub part 22 is attached to the rotation axis 61 by penetrating the rotation axis 61 through a hole which is formed in the base portion 22*a* (not shown in the figures) so that the base portion 22*a* is sandwiched between the inner face of the ceiling face portion 60*a* of the case 60 and the upper face of the main part 21. Also, the sub part 22 is attached to the main part 21 so as to open an elongated space between one of marginal portions along the length direction of the arm portion 22*b*; and one of a straight-line marginal portion 21*d* ranging from a formation portion of the axis hole 21*a* to the arc-like marginal portion 21*b* of the main part 21. Due to the above-mentioned space, the catcher 2 is provided with the hooking groove 20 of the striker body 1 wherein an inlet opening 20*a* faces the near front side F in the standby position. In the standby position, the arm portion 22*b* of the sub part 22 is positioned in front of the straight-line marginal portion 21*d* of the main part 21. Also, the end of the arm portion 22*b* is positioned on the lateral side of a movement locus x of the striker body 1, and further, the outer end side of the straight-line marginal portion 21*d* of the main part 21 is positioned on the movement locus x of the striker body 1. (FIG. 3)

The linkage means 3 is provided with the linkage gear member 30, the first slider 31, and second slider 32. The linkage gear member 30 is provided with a small-diameter gear member 30*a* connected to the catcher 2 side; and a large-diameter gear member 30*b* connected to a braking device 5 side and rotated together with the small-diameter gear member 30*a*. In the example shown in the figures, the linkage gear member 30 is integrally assembled with the upper end of an axis to the ceiling face portion 60*a* of the case 60 in a roughly intermediate position of the length direction of the case 60. Also, the linkage gear member 30 is placed inside the case 60 in such a way that the side of the small-diameter gear member 30*a* is placed on the upper side by an axis 62 arranging an axis line in an orthogonal direction relative to the ceiling face portion 60*a*. In the example shown in the figures, the linkage gear member 30 is structured as a two-stage gear integrally comprising the small-diameter gear member 30*a* and the large-diameter gear member 30*b*.

The first slider 31 is structured in such a way as to form a long bar in the length direction of the case 60, and attached to the case 60 so as to slide and move along the length direction of the case 60 along the inner wall positioned in the deep back side B in the case 60. In the first slider 31, on the side facing the near front side F, the rack 31*a* engaging with the pinion-like portion of the catcher 2; and a rack 31*b* engaging with the small-diameter gear member 30*a* of the linkage gear member 30 are respectively formed. Therefore, in the example, when the catcher 2 in the standby position is rotated toward a retracted position, the first slider 31 is moved toward one end side 60*b* of the case 60, and by the first slider 31 moved as described above, the normal rotation of the linkage gear member 30 can be carried out.

On the other hand, the second slider 32 is structured in such a way as to form a long bar in the length direction of the case 60, and attached to the case 60 so as to slide and move along the length direction of the case 60 along the inner wall positioned in the near front side F of the case 60. The linkage gear member 30 is positioned between the second slider 32 and the first slider 31, and in the second slider 32, a rack 32*a* engaging with the large-diameter gear member 30*b* of the linkage gear member 30 is formed on the side facing the deep back side B. Therefore, in the example, when the catcher 2 in the standby position is rotated toward the retracted position, the first slider 31 is moved toward one end side 60*b* of the case 60. When the normal rotation of the linkage gear member 30 is carried out by the first slider 31 moved as above, the second slider 32 is moved toward other end side 60*c* of the case 60.

Also, in the example, due to the tension coil spring 4 having one end 40 fastened to the biased position of the linkage gear member 30; and other end 41 fastened to a projection 63 formed in the ceiling face portion 60*a* in the other end side 60*c* of the case 60, both a state (state in FIG. 3) wherein the first slider 31 is completely moved to the other end side 60*a* of the case 60; and a state (state in FIG. 4) wherein the first slider 31 is completely moved to one end side 60*b* of the case 60, are maintained due to the operation of the spring 4. Therefore, when the catcher 2 is on a standby position side rather than the intermediate position between the standby position and the rotated position, the catcher 2 receives an urging force toward the standby position, and when the catcher 2 is on the rotated position side rather than the intermediate position, the catcher 2 receives an urging force toward the rotated position.

More specifically, when the catcher 2 is in the intermediate position, one end of a spring 40, the other end of the spring, and a rotation center 30*c* of the linkage gear member 30 are positioned in one straight line, and at this time, the spring is most stretched. Also, when the first slider 31 is completely moved to the other end side 60*c* of the case 60, the one end of the spring 40 is positioned in the deep back side B rather than the rotation center, and shrank more than at the time of the intermediate position. Also, when the second slider 32 is completely moved to one end side 60*b* of the case 60, the one end of the spring 40 is positioned in the near front side F rather than the rotation center 30*c*, and shrank more than at the time in the intermediate position.

Therefore, in either one of cases where the catcher 2 is in the standby position (FIG. 3); and where the catcher 2 is in rotated position (FIG. 4) wherein the inlet opening 20*a* of the hooking groove 20 faces the deep back side B, the catcher 2 is stably positioned in those positions due to an urging force of the spring 40, respectively.

When the rotational body D is rotated toward the reference position, in the predetermined rotational position, the striker body 1 provided on the rotational body D side bumps into the straight-line marginal portion 21*d* approaching the hooking groove 20 of the main part 21 comprising the catcher 2 in the standby position. As mentioned above, when the striker body 1 is bumped, the main part 21 is rotated at the center of the rotation axis 61 and pushed in, and the inlet opening 20*a* of the hooking groove 20 gradually faces the deep back side B and the striker body 1 is captured by the catcher 2. The catcher 2 capturing the striker body 1 is rotated (moved forward) beyond the intermediate position due to an rotational force of the rotational body D facing the reference position, and rotated to the rotated position due to an urging force. The rotational body D wherein the striker body 1 is captured by the catcher 2 is rotated to the reference position due to the rotation of the catcher 2 by force. Thus, the rotational body D rotated toward the reference position can be securely closed. On the other hand, when the rotational body D positioned in the reference position is rotated in an opened direction, the catcher 2 capturing the striker body 1 in the rotated position is rotated (moved backward) beyond the intermediate position due to the movement of the striker body 1, and reaches the standby position due to an urging force. In the standby position, the inlet opening 20*a* of the hooking groove 20 faces the near front side F, so that the striker body 1 slips out of the hooking groove 20 and is released from the catcher 2. Thus, the rotational body D becomes free and is opened. At the same time, the catcher 2 is continued to be positioned in the standby position due to an urging force until the rotational body D is rotated toward the reference position next time.

Also, in the example, the end portion facing other end side 60*c* of the case 60 of the second slider 32 is connected to a movable member 50 side of the braking device 5, and the braking of the braking device 5 can be applied to the rotation toward the rotated position of the catcher 2 through the linkage gear member 30.

Thus, in the example, the movable member 50 comprising the braking device 5 can be moved by the linkage gear member 30 more than the rotation volume when the catcher 2 in the standby position is rotated to the rotated position. Due to a resistance force applied to the movement of the movable member 50 of the braking device 5, the braking can be provided for the rotation of the catcher 2 as much as possible. Specifically, in the process wherein the rotational body D in the open position is rotated to the reference position, the striker body is captured by the catcher 2 in a predetermined position, and due to the forward rotation toward the rotated position of the catcher 2 after the above-mentioned capture, the rotational body D is retracted to the reference position. Also, due to the forward rotation of the catcher 2, the linkage gear member 30 connecting the small-diameter gear member 30*a* to the catcher 2 side is rotated to the extent of the forward rotation. However, since the large-diameter gear member 30*b* of the linkage gear is connected to the movable member 50 side of the braking device 5, the movable member 50 side can be moved more than the forward movement rotation volume of the catcher 2. Thus, in the final stage wherein the rotational body D reaches the reference position, a braking force can be applied to the rotational body as much as possible.

In the case that the braking device 5 is a load-response type braking device 5, the braking can be further applied to the rotational body D immediately before the rotational body D reaches the reference position.

In the example, the braking device 5 comprises a piston which is not shown in the figures and a cylinder 52 wherein viscose fluid such as silicon oil and so on is encapsulated, and is structured in such a way as to provide the braking for pushing a piston rod 51 into the cylinder 52 due to a resistance of the viscose fluid. The braking device 5 is housed in the case 60 in such a way that the cylinder 52 and the piston rod 51 are arranged along the length direction of the case 60. In the example, the projecting end of the piston rod 51 is fastened to the case 60 in the other end side 60*c* of the case 60, and one end of the second slider 32 is connected to the end portion of the opposite side of the projecting side of the piston rod 51 of the cylinder 52. In the example, the cylinder 52 is the movable member 50 comprising the braking device 5, and the cylinder 52 is pushed into the other end side 60*c* of the case 60 due to the movement of the second slider 32, so that the piston is relatively pushed into the cylinder 52.

Thus, in the example shown in the figures, the braking of the braking device 5 can be provided for the movement of the first slider 31 which is moved by the rotation toward the rotated position from the standby position of the catcher 2 through the linkage gear member 30 and the second slider 32. Accordingly, in the final stage of the rotation toward the reference position of the rotational body D, the rotation can be slowly carried out.

When the rotational body D is rotated toward the open position from the state where the catcher 2 captures the striker body and is in the rotated position, specifically, when the door D' in the closed position is opened, the catcher 2 is rotated to the standby position, and accompanied with this, the first slider 31 is moved to the other end side 60*c* of the case 60. Accordingly, the linkage gear member 30 is rotated reversely, and the second slider 32 is moved to one end side 60*b* of the case 60. Due to the movement of the second slider 32, the cylinder 52 is also moved to one end side 60*b* of the case 60, and the piston rod 51 is drawn out of the cylinder 52 again.

As for so-called load-response type braking device 5, i.e., the braking device 5 structured in such a way that the faster the piston connected to the piston rod 51 is moved or relatively moved, the stronger resistance of the viscous fluid the piston receives, a damper shown in a Japanese Unexamined Patent Application Publication (TOKKAI) No. 2005-188693 disclosed by applicants of this invention can be employed.

FIGS. 7, 8 show an example wherein one portion of the structure of the retracting mechanism shown in FIGS. 1 to 6 is changed. In the example shown in FIGS. 7, 8, mainly, the linkage means 3 which carries out the linkage between the catcher 2 and the braking device 5 is made differently from the example shown in FIGS. 1 to 6. Since other structures of the example shown in FIGS. 7, 8 are substantially the same as those of the example shown in FIGS. 1 to 6, concerning the same portions, the same symbols used in FIGS. 1 to 6 are used in FIGS. 7, 8, and the explanation is omitted.

In the example shown in FIGS. 7, 8, the braking device 5 is housed between a pushed-in portion (hereinafter, called a rod push-in portion 7) of a piston rod 54 connected to the piston; and a pushed-in portion (hereinafter called a cylinder push-in portion 8) of a back end portion 53*a* of the opposite of a projecting side of the piston rod 54 of a cylinder 53. Specifically, in the example, the catcher 2 is provided in one end side 60*b* of the slender case 60, and the rod push-in portion 7 is positioned on the catcher 2 side between the catcher 2 and the other end side 60*c* of the case 60. The cylinder push-in portion 8 is positioned in the other end side 60*c* of the case 60, and the braking device 5 is clamped and retained between both push-in portions 7, 8. The braking device 5 is retained between both push-in portions 7, 8 in such a way that the moving direction of the piston (not shown) is along the length direction of the case 60. The braking device 5 is retained in a state wherein the cylinder 53 is freely fitted into a through-bore 64*a* of a retaining portion 64 providing the through-bore of the cylinder 53 shown by a symbol 64*a* in the figures of the near front side F sandwiching an imaginary straight line s running through roughly in the middle of the width direction of the case 60.

Also, a linkage pinion 33 attached to be rotatable with a rotational axis parallel to a rotational axis of the catcher 2 relative to the case 60, is provided on the lateral side of the catcher 2 and between the catcher 2; and an outer end 54*a* of the piston rod 54 of the braking device 5.

Moreover, inside the case 60, a first slider 34 comprising the pinion-like portion 21*c* of the catcher 2 and a rack 34*a* engaging the linkage pinion 33; and a second slider 35 comprising a rack 35*a* engaging the linkage pinion 33 on the opposite side of the first slider 34, are provided.

In the example, the cylinder push-in portion 8 is moved due to the movement of the first slider 34, and the rod push-in portion 7 is moved due to the movement of the second slider 35.

Specifically, the first slider 34 and the second slider 35 are attached to the case 60 in such a way as to regularly carry out the sliding movement toward one end side 60*b* of the case 60; and the slide movement toward the other end side 60*c*, along the length direction of the case 60. The first slider 34 is provided in the deep back side B sandwiching the imaginary straight line s; a rotation center 33*a* of the linkage pinion 33 is positioned on the imaginary straight line s; and the second slider 35 is positioned in the near front side F sandwiching an imaginary straight line y. The first slider 34 is provided with the rack 34*a* with a predetermined length engaging the pinion-like portion 21*c* in the portion located in the backside of the pinion-like portion 21*c* of the catcher 2. Also, the first slider 34 includes the rack 34*a* with the predetermined length engaging the linkage pinion 33 in the portion located in the backside of the linkage pinion 33. Also, the second slider 35 includes the rack 35*a* with the predetermined length in the portion located in front of the linkage pinion 33. Also, in the example, the outer end 54*a* of the piston rod 54 is attached to the end portion facing the other end side 60*c* of the case 60 of the second slider 35, and the end portion functions as the rod push-in portion 7. Also, an extension bar body 37 is provided between the first slider 34 and the other end side 60*c* of the case 60. The extension bar body 37 is connected to the first slider 34 through a coupling 36; integrated into the first slider 34; and moved to slide. In the end portion of the other end side 60*c* of the case 60 in the extension bar body 37, a projecting portion 37*a* which projects toward the near front side F and contacts with the back end portion 53*a* of the cylinder 53 from the other end side 60*c* of the case 60, is formed. In the example, the projecting portion 37*a* functions as the cylinder push-in portion 8.

When the catcher 2 is in the standby position, the piston rod 54 is projected the most from the inside of the cylinder 53. (FIG. 7)

When the catcher 2 captures the striker body 1 and is rotated toward the rotated position, the first slider 34 engaging the rack 34*a* with the pinion-like portion 21*c* of the catcher 2 is moved to slide toward one end side 60*b* of the case 60, and the cylinder push-in portion 8 is moved toward one end side 60*b* of the case 60. Also, when the first slider 34 is moved as mentioned above, the linkage pinion 33 is also rotated with the above-mentioned movement. The second slider 35 engaging the rack 35*a* with the linkage pinion 33 rotated as mentioned above on the opposite side of the first slider 34 is moved toward the other end side 60*c* of the case 60 which is opposite to the first slider 34. Accordingly, the rod push-in portion 7 is moved toward the other end side 60*c* of the case 60. (FIG. 8) Thus, in the example, the piston can be pushed into the cylinder 53 comprising the braking device 5 through the first slider 34 and the second slider 35 more than the rotation volume wherein the catcher 2 in the standby position is rotated to the rotated position. Accordingly, the braking of the load-response type braking device 5 can be applied to the rotational body D as much as possible immediately before the rotational body D reaches the reference position.

When the rotational body D positioned in the reference position is moved backward and rotated to the open position, the catcher 2 is also moved backward and rotated to the standby position. Thus, the first slider 34 is moved to the other end side 60*c* of the case 60; the second slider 35 is moved to one end side 60*b* of the case 60; and the piston rod 54 is returned to the state of being projected the most from the inside of the cylinder 53 again. (FIG. 7)

Incidentally, in the example, the tension coil spring 4 positions the catcher 2 in the standby position and the rotated position respectively by the urging force thereof through the linkage pinion 33. In the example, through a linkage rod 38 whose one end is rotatably attached to a position 33*b* biased from the rotation center 33*a* of the linkage pinion 33; and whose the other end is fastened to the one end of the spring 40 of the tension coil spring 4, the tension coil spring 4 and the linkage pinion 33 are attached. Also, the spring other end 41 of the tension coil spring 4 is fastened to a fastening portion 65 standing up from the inner face of the case 60 as the supporting body of the linkage pinion 33 through a through-bore 37*b* which is long in the moving direction of the extension bar body 37 formed in the extension bar body 37. When the spring one end 40, the spring other end 41, and the rotation center 33*a* of the linkage pinion 33 are positioned on the same imaginary one line, the tension coil spring is most stretched. At this moment, the catcher 2 is positioned in the intermediate position through the first slider 34. In the example, due to the linkage rod 38, a spring winding portion of the tension coil spring 4 cannot contact the linkage pinion 33, and the spring winding portion cannot prevent the rotation of the linkage pinion 33.

Incidentally, all contents of the specification, claims, figures, and abstract of Japanese Patent Application No. 2006-332237 filed on Dec. 8, 2006 are cited herein and incorporated as the disclosure of the specification of the present invention.

What is claimed is:

1. A retracting mechanism, comprising:

a striker body provided in either one of a rotational body or a main body to which the rotational body is rotatably attached;

a catcher provided on the other of the rotational body or the main body for capturing the striker body when the rotational body is rotated from an open position to a reference position;

a braking device for applying a resistance force to a movement of a movable member; and a linkage device between the catcher and the braking device, wherein the catcher is provided so as to be reciprocatingly rotatable between a standby position and a rotated position for capturing the striker body at the standby position, and rotating forward to the rotated position, wherein due to the linkage device, the movable member comprising the braking device is moved farther in proportion to a rotation volume of the catcher, and wherein the linkage device comprises a linkage gear member including a small-diameter gear member connected to the catcher, and a large-diameter gear member connected to the movable member of the braking device and rotating together with the small-diameter gear member, the small-diameter gear member and the large-diameter gear member being coaxially arranged.

2. A retracting mechanism according to claim 1, wherein the braking device is a load-response type braking device.

3. A retracting mechanism according to claim 1, wherein the braking device comprises a piston and a cylinder and is configured to apply resistance of viscose fluid encapsulated in the cylinder to a push-in movement of the piston, wherein the linkage device further comprises:

a first slider having a first rack engaging with a pinion-like portion formed in the catcher and the small-diameter gear member of the linkage gear member; and a second slider having a second rack engaging with the large-diameter gear member of the linkage gear member, and wherein due to a movement of the second slider, the piston comprising the braking device is pushed in or relatively pushed in.

4. A retracting mechanism, further comprising a catcher unit for housing the catcher, the braking device, and the linkage device according to claim 3, wherein the catcher unit has a width and a length so that the first and second racks are moved along a direction of the length, and wherein the width of the catcher unit has a size so as to be housed between a side face on a side opposite to a face of a door as the rotational body bumping in a doorstop portion of a door frame as a main body and a side face of the door frame on a side opposite to the side face.

5. A fixing structure for fixing the retracting mechanism according to claim 1, wherein when a space between a free end of a door as the rotational body and a door frame as the main body comes to a range of 10% to 20% of a width of the door, the catcher captures the striker body.

6. A retracting mechanism according to claim 1, further comprising a tension coil spring having one end attached to the linkage gear member in a position biased from a rotation center, and the other end of the coil spring fastened to a fastened position, wherein when a front end of the spring, a back end of the spring, and the rotation center of the linkage pinion are positioned in a linear line, the tension coil spring is most stretched, and the catcher is positioned in an intermediate position between the standby position and the rotated position through the first slider.

7. A retracting mechanism according to claim 6, wherein the tension coil spring applies an urging force to the linkage gear member for moving the catcher toward the standby position when the catcher is positioned closer a standby position side than the intermediate position between the standby position and the rotated position, and the urging force to the linkage gear member for moving the catcher toward the rotated position when the catcher is positioned closer the rotated position than the intermediate position.

8. A retracting mechanism according to claim 1, wherein the catcher has a hooking groove composed of a straight-line marginal portion and an arm portion for capturing the striker body, the straight-line marginal portion being positioned on a movement locus of the striker body and the arm portion being positioned on a lateral side of the movement locus of the striker body.

9. A retracting mechanism, comprising:

a striker body provided in either one of a rotational body or a main body to which the rotational body is rotatably attached;

a catcher having a pinion portion and provided on the other of the rotational body or the main body for capturing the striker body when the rotational body is rotated from an open position to a reference position;

a braking device for applying a resistance force to a movement of a movable member, having a cylinder and a piston rod connected to the cylinder; and a linkage device disposed between the catcher and the braking device, including a linkage gear member, a first slider disposed on one side opposite to the braking device and having a rack engaging the pinion portion of the catcher and the linkage gear member, and a second slider disposed on the other side along with the braking device and having a rack engaging the linkage gear member; and wherein the catcher is provided so as to be reciprocatingly rotatable between a standby position and a rotated position for capturing the striker body at the standby position, and rotating forward to the rotated position, and wherein the first slider is connected to one of the cylinder or the piston rod and the second slider is connected to the other of the cylinder or the piston rod such that a movement of the piston rod along with the cylinder is greater than the rotation of the catcher due to a movement of the first slider and the second slider.

10. A retracting mechanism according to claim 9, further comprising a tension coil spring having one end rotatably attached to a linkage pinion in a position biased from a rotation center of the linkage pinion, and the other end fastened to a supporting body of the linkage pinion, wherein when a front end of the spring, a back end of the spring, and a rotation center of the linkage pinion are positioned in a linear line, the tension coil spring is most stretched, and the catcher is positioned in an intermediate position between the standby position and the rotated position through the first slider.

11. A retracting mechanism according to claim 10, wherein the tension coil spring applies an urging force to the linkage pinion through the linkage rod for moving the catcher toward the standby position when the catcher is positioned closer the standby position than the intermediate position between the standby position and the rotated position, and the urging force to the linkage pinion through the linkage rod for moving the catcher toward the rotated position when the catcher is positioned closer the rotated position than the intermediate position.

12. A retracting mechanism according to claim 9, further comprising a catcher unit for housing the catcher, the braking device, and the linkage device, wherein the catcher unit has a width and a length so that first and second racks are moved along a direction of the length, and wherein the width of the catcher unit has a size so as to be housed between a side face on a side opposite to a face of a door as the rotational body bumping in a doorstop portion of a door frame as a main body and a side face of the door frame on a side opposite to the side face.

13. A retracting mechanism according to claim 9, wherein the catcher has a hooking groove composed of a straight-line marginal portion and an arm portion for capturing the striker body, the straight-line marginal portion being positioned on a movement locus of the striker body and the arm portion being positioned on a lateral side of the movement locus of the striker body.

14. A retracting mechanism according to claim 9, wherein an end of the cylinder or the piston rod is connected to an end of the second slider.

* * * * *